United States Patent [19]

Shapiro

[11] 4,206,835

[45] Jun. 10, 1980

[54] LUGGAGE

[75] Inventor: Harry G. Shapiro, Chevy Chase, Md.

[73] Assignee: York Luggage Corporation, Lambertville, N.J.

[21] Appl. No.: 942,193

[22] Filed: Sep. 14, 1978

[51] Int. Cl.[2] ..... A45C 13/00

[52] U.S. Cl. ..... 190/60; 190/1; 190/52; 190/41 B; 190/43

[58] Field of Search ..... 190/1, 43, 60, 52, 41 Z, 190/41 B, 41 R, 42, 49

[56] References Cited

U.S. PATENT DOCUMENTS

| | | | |
|---|---|---|---|
| 2,774,450 | 12/1956 | Smallberg | 190/43 |
| 3,622,056 | 11/1971 | Droeger | 190/52 UX |

*Primary Examiner*—George T. Hall

*Attorney, Agent, or Firm*—Shapiro and Shapiro

[57] ABSTRACT

A flexible garment bag and a carrying case are constructed to enable their separable connection to one another so that the assembly may be carried as a compact unit. The garment bag comprises first and second panels of flexible material connected to one another at their edges, the first panel having a longitudinally extending opening provided with a closure. The carrying case comprises a bottom wall, side walls, end walls and a top wall, the top wall having a handle secured thereto. The carrying case has a length substantially equal to the width of the garment bag, and the garment bag has a length sufficient to substantially cover the bottom wall and the side walls of the carrying case in the assembled relationship of the garment bag and carrying case. Connector means is secured to the carrying case, and longitudinally spaced connector means are secured to the second panel to extend from each end of the garment bag for separable connection to the connector means secured to the carrying case.

17 Claims, 7 Drawing Figures

LUGGAGE

The invention relates to improvements in luggage of the multi-container type, and is more particularly directed to luggage of the type which includes a flexible garment bag.

BACKGROUND OF THE INVENTION

Travelers frequently carry a garment bag and a second piece of luggage. Though this requires that the garment bag be carried in one hand and the second piece of luggage in the other hand, the traveler will bear this discomfort for at least two reasons. Firstly, he or she may wish to arrive at the destination with the garments in unwrinkled condition. Secondly, by placing the garments in a garment bag, a carrying case may be used which is suitably small so that when traveling by air, both pieces of luggage may be brought on board to thereby circumvent the ordeal of claiming luggage at the baggage pick-up area where a considerable amount of time is lost. Carrying cases are being made which are small enough to be stored under the seat or in an overhead compartment and racks are being provided for the hanging of garment bags. Moreover, airlines are realizing more and more the desirability of permitting passengers to bring luggage on board so that the passenger may leave directly with his or her luggage. Accordingly, facilities are being provided to stow bags and carrying cases in the passenger area at places other than under seats and on racks.

It has been proposed to provide luggage which is designed to carry garments and other articles. In U.S. Pat. No. 3,729,038-Ekeson it is proposed that a wrap-around cover which includes pockets to provide extra holding space for personal articles may also serve to retain clothing between the wrap-around cover and the carrying case about which the cover is positioned. No provision is made, however, for protecting the clothing from the sides, and when the cover is removed, the clothing falls away. The wrap-around of Ekeson is not a rpotective garment bag, and such arrangement has limitations. Moreover, the wrap-around is of a length to fit and be tailored to a particular bag.

In U.S. No. 3,291,266 Komroff a foldable garment bag is provided with a flap which is designed to be assembled into a carrying case in the sense that the integrity of the garment bag and the integrity of the carrying case are maintained.

Various kinds of container combinations are disclosed in U.S. Pat. Nos. to Ward—3,122,225; Benzel—3,410,376; Ohyama—3,830,348; Hoana—3,837,447; and Gregg et al—3,967,708.

BRIEF DESCRIPTION OF THE INVENTION

The luggage of the invention comprises a flexible garment bag and a carrying case which are constructed to provide a unitary assembly to enable carrying both the garment bag and the carrying case with one hand or slung over the shoulder of the traveler, while affording the same suitable protection for clothing afforded by a known type of flexible garment bag and the same storage space and protection of known types of carrying cases. In fact, together or assembled, there is a synergistic effect afforded by the assembly in that there is a minimum of wrinkling of the garment or garments within the garment bag, the total volume of both the garment bag and the carrying case is maintained, and the resultant overall package of the combination of the garment bag and carrying case is more convenient to carry than the garment bag alone or, stated in another way, the assembly of garment bag and carrying case is an convenient to carry as the carrying case alone. Moreover, the garment bag-carrying case assembly takes up a minimal amount of space considering the quantity of clothing and other goods which may be stored and transported by the assembly.

Briefly, the garment bag-carrying case assembly of the invention comprises a garment bag having first and second panels of flexible material connected to one another at their edges, the first panel having a longitudinally extending opening provided with a closure as is common in the art. The carrying case has a bottom wall, side walls, end walls and a top wall, the top wall having a handle secured thereto. The carrying case has a length substantially equal to the width of the garment bag, and the garment bag has a length sufficient to substantially cover the bottom wall and side walls of the carrying case. Connector means, preferably positioned on the top wall, is secured to the carrying case, and longitudinally spaced connecting means are secured to the second panel to extend from each end of the garment bag for separable connection to the connector means secured to the carrying case.

With the aforementioned longitudinally spaced connector means of the garment bag and the connector means secured to the carrying case in connected condition, the carrying case serves as a support for the garment bag with the garment bag assuming a generally U-shaped contour. The carrying case acts as a form about which the garment bag is positioned, the carrying case providing a substantial radius of curvature to minimize the wrinkling of a garment or garments positioned in the garment bag. The handle for carrying the assembly or the means enabling the attachment of a shoulder strap for carrying the assembly is connected to or furnished by the carrying case.

In the preferred form of the invention, the longitudinally spaced connector means secured to the second panel to extend from each end of the garment bag are connected to the garment bag so that the position of the connector means may be adjusted to accommodate the differences in bulk of the garment bag occasioned by the amount of clothing in the bag.

In still another preferrred aspect of the invention, the garment bag is made with a reinforcing member secured to and extending transversely of the second panel midway of the length of the garment bag, the reinforcing member having means connected thereto to support the assembly of garment bag and carrying case when the assembly is placed on a horizontal surface such as on the ground.

Another object of the invention is to provide a garment bag structure which enables its assembly with a carrying case to furnish the aforementioned purposes, functions, advantages and improved results.

The advantages and improved results afforded by the garment bag-carrying case assembly of the invention and the garment bag structure of the invention will be apparent from the following detailed description of a preferred embodiment of the invention, taken in conjunction with the drawings.

Description of the Preferred Embodiments

Figure 1:
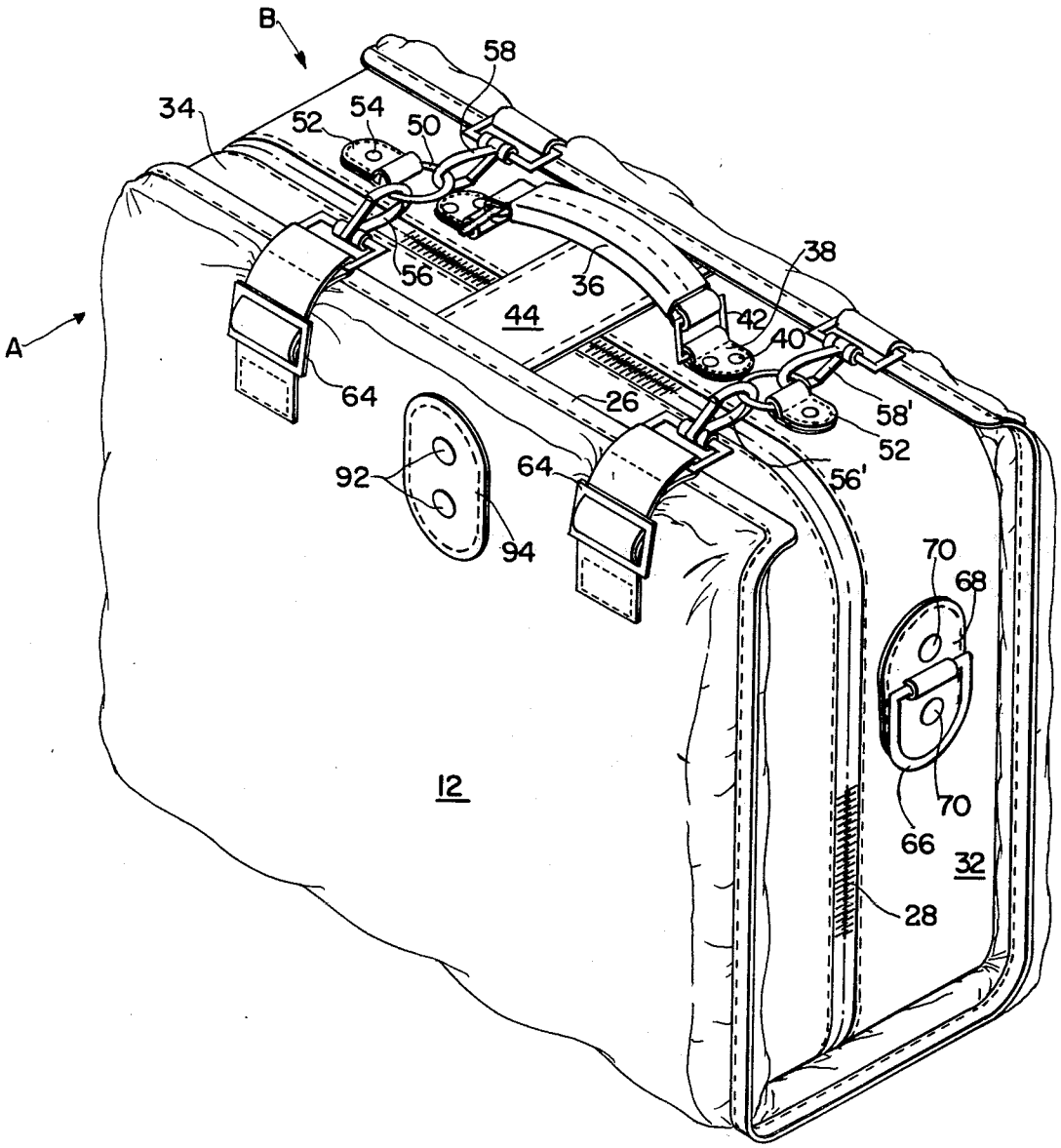
FIG. 1 is a perspective view of a garment bag and carrying case in assembled relationship ready for carrying.
Figure 2:
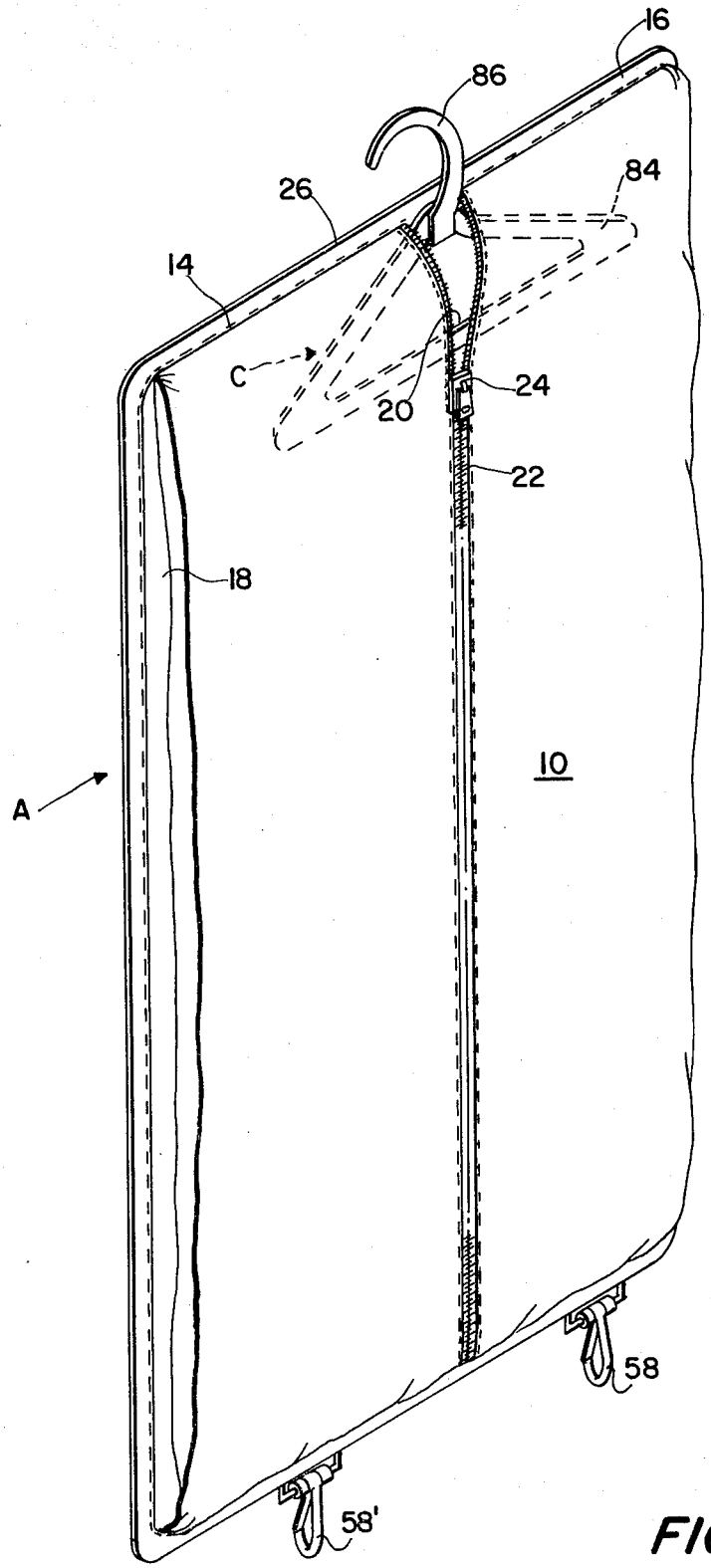
FIG. 2 is a perspective view of the garment bag in its extended condition showing one side thereof.

Referring to FIGS. 1–4, a garment bag-carrying case assembly in accordance with the invention comprises a garment bag A and a carrying case B. The garment bag comprises first and second panels 10, 12 of flexible material connected to one another at their peripheral edges 14. The edges are sewn or heat sealed to one another, and preferably the edges are reinforced with a strip 16. To impart greater volume to the bag, one of the panels may be provided with a gusset portion 18 along its longitudinal sides, as shown in FIG. 2. The garment bag is provided with a longitudinally extending opening 20 provided with a closure 22 preferably in the form of a slide fastener. Preferably, and as shown in FIG. 2, the opening and slide fastener are positioned centrally of the panel 10, and when the slider 24 of the fastener is in its fully closed position, the slider is located at the top 26 of the garment bag, as is well known in the art. If desired, the slide fastener may be located at the side of the garment bag in the area of the gusset 18, or the opening and slide fastener may extend diagonally downward from the top of the panel 10.

The flexible material of which the panels 10 and 12 are made preferably is weather- or water-resistant, sewable and/or heat sealable, for example, plastic sheet material such as vinyl sheeting, or a coated fabric such as canvas or the like coated with a suitable waterproofing composition. Various waterproofing compositions may be used, for example, polyvinyl chloride, copolymers of vinyl chloride and vinyl acetate, copolymer and terpolymers of styrene, etc.

The carrying case B is constructed so that it is capable of supporting the garment bag. The carrying case may be what is known in the trade as "soft-side" luggage or "hard-side" luggage. Soft-side luggage has a measure of stiffness though it is made of fabric or sewable material; the sections thereof are made with supportive means or frame elements. As known in the art, stiff welting or frames of aluminum or steel rod are used at the seamed areas or junctures of the top, end, side and bottom walls. In hard-side luggage, the shells are molded or cast of a suitable plastic composition or metal alloy. A valance member is secured to the peripheral edge of at least one of the shells, and the shells are hinged to one another. To this extent, the constructions of the carrying case or cases are well known in the art. Also as is common in the art, the top wall of the case is provided with a handle. The carrying case has the usual opposite side walls, a bottom wall and end walls. The bottom wall is provided with feet or spacers to engage a horizontal surface such as the ground.

In accordance with the invention, soft-side or hard-side luggage as described is provided with connector means secured thereto, and preferably such connector means is positioned on the top wall of the case where the usual handle is located. The carrying case is made of a length substantially equal to the width of the garment bag, and the garment bag has a length sufficient to substantially cover the bottom wall and side walls of the carrying case. Longitudinally spaced connector means are secured to the second panel of the garment bag to extend from each end of the garment bag for separable connection to the connector means secured to the carrying case.

Figure 4:
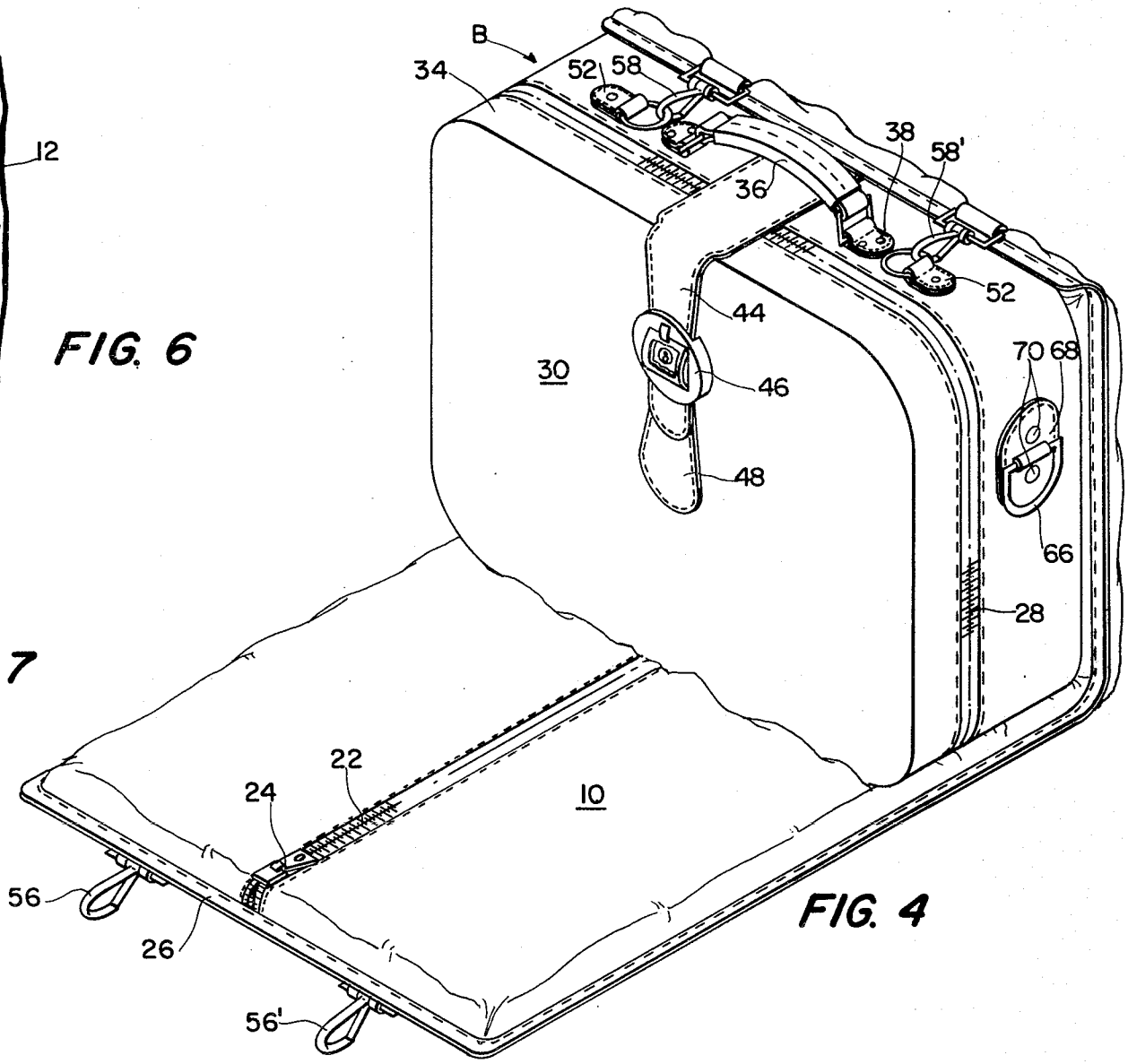
FIG. 4 is a perspective view showing the manner in which the garment bag and the carrying case are separably connected to one another.

Referring to FIGS. 1 and 4 which illustrate a carrying case B of soft-side luggage, a pair of case sections are hinged to one another on the underside of the case by a pair of longitudinally spaced hinges (not shown), as is common in the art. The case sections are made of a sewable material, for example, leather, plastic sheet material such as vinyl resin sheeting, or a coated fabric such as canvas coated with a suitable waterproofing composition as previously described in connection with the flexible material used for the panels of the garment bag. The hinged case sections are provided with a suitable fastener along their peripheral edges, such as a slide fastener 28. The carrying case comprises a bottom wall (not shown), side walls 30, end walls 32, and a top wall 34. A handle 36 is connected to one case section by longitudinally spaced connecting members 38 which are sewn to the top wall 34 and reinforced by rivets 40. Pivot rings 42 may be positioned intermediate the handle 36 and the connecting members 38.

Regarding the closure 28 for the carrying case, a slide fastener or a pair of slide fasteners are used in the manner whereby the case is closed when a pair of sliders are located adjacent one another midway of the length of the top side of the case whether a single slide fastener or a pair of slide fasteners is used. With fastener elements of the so-called double-acting type, a single slide fastener with a pair of opposed sliders may be used and is preferred. Where the fastener elements are the single-acting type, a pair of slide fasteners are used, the top or top-stop ends of which are located midway of the top of the case. In any event, whether a single double-acting slide fastener or two slide fasteners of the one way-acting type are used, an overall length of slide fasteners is selected so that the end of the fastener or fasteners terminate on the underside of the case near the juncture of the underside with the side walls of the case. A strap 44 has one end thereof sewn to either the top side of one case section or such case section's side wall. The strap is of a length to extend across the parting line of the case across the top side of the opposing case section and down the side wall 30 of the opposed case section. A buckle lock 46 is mounted on the side wall by the connection thereof to a mounting strip 48 sewn to the side wall. The buckle is of a known construction which is commercially available. A carrying case as above described is known in the art, and is described for example in U.S. Pat. No. 3,628,640; Molnar granted Dec. 21, 1971.

As shown in FIGS. 1 and 4, connector means secured to the carrying case is preferably in the form of a pair of longitudinally spaced rings 50. The rings, which preferably are D-rings, are pivotally connected to members 52 which are sewn to the top wall 34 and the connection is made additionally secure by extending and securing a rivet 54 through the connecting member 52 and through the material of the top wall. As previously indicated, the length of the carrying case B is substantially equal to the width of the garment bag A and this will be evident from a viewing of FIGS. 1 and 4.

Figure 3:
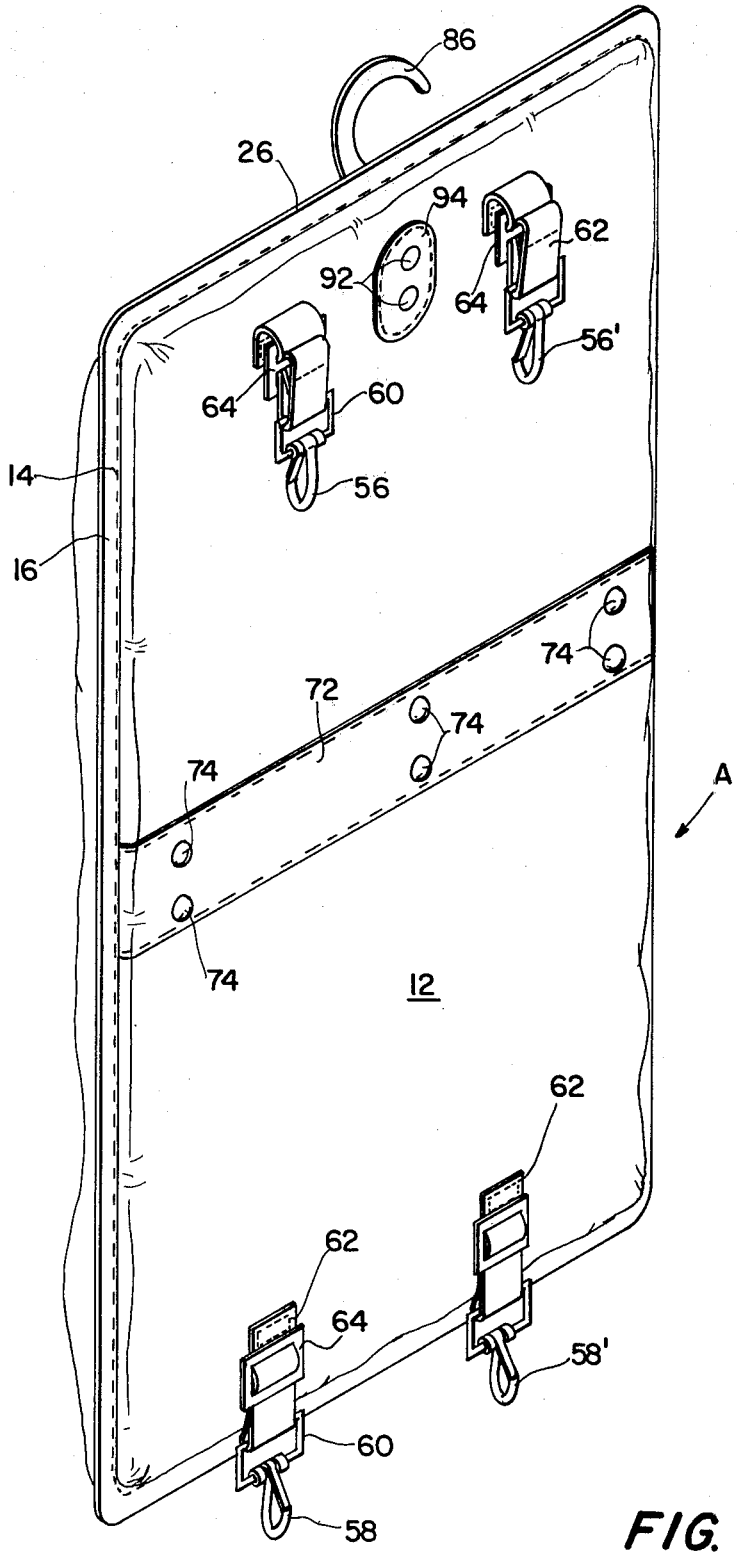
FIG. 3 is a view similar to FIG. 2 showing the opposite side of the garment bag.

Referring to FIGS. 1, 3 and 4, the panel 12 of the garment bag A is provided with longitudinally spaced connector means 56, 56' and 58, 58'. The connectors 56 and 56' and 58, 58' are respectively spaced apart a distance substantially equal to the spacing between the spaced rings 50 on the carrying case B so that as shown in FIG. 1, when the assembly is made, the bottom and sides of the carrying case are covered by the garment bag. Preferably, and as shown, the carrying case and garment bag have a dimentional relationship so that the ends of the garment bag are turned over onto the top wall 34 and terminate on each side of the handle 36.

As illustrated, the connectors 56, 56' and 58, 58' are of a snap hook construction, a type of quick connect and disconnect connector which is well-known. This type of connector, which is called "dog-leash" type, has a leaf spring member coacting with the free end of a rigid curved member. The fasteners may each be fixed to a ring member 60 which in turn is pivotally connected to a strap 62 which is sewn to the panel 12. In order to accommodate the differences in bulk for the number of garments or types of garments in the garment bag, the straps of at least a pair of the connectors may be provided and preferably are provided with a member 64 which permits shortening or lengthening of the strap and thereby the adjustment of the positions of the quick connect and disconnect connectors for attachment to the rings 50. Preferably, the adjustability is provided for the connectors which are located to extend from the lower end of the garment bag. In this way, the upper end of the garment bag which has hangers therein may first be connected to the carrying case by snapping the connectors 56, 56' onto the rings 50, folding the garment bag around the carrying case, and then, after suitable adjustment of the lengths of the straps for the connectors 58, 58' so that the filled garment bag will snugly engage the carrying case, such connectors are snapped onto the rings 50. It will be apparent that the assembly as shown in FIG. 1 may then be carried by means of the handle 36. It is within the scope of the invention to use any desired type of quick connect and disconnect type of connector.

If it is desired to carry the assembly of FIG. 1, and still leave the hands free, each end of the carrying case B is provided with connector means to enable securing a carrying strap to the carrying case. For this purpose a D-ring 66 preferably is pivotally connected to a base member 68 of heavy material such as leather or synthetic leather which in turn is secured to each end wall 32 as by sewing. To reinforce the connection, rivets 70 may be extended through the base member and the wall 32. The carrying strap (not shown) is provided with suitable quick connect and disconnect connectors at the ends thereof, for example, connectors of the type as shown at 56, 56' and 58, 58'. When the garment bag and the carrying case are separated, the carrying strap may be used to simply carry the carrying case.

When it is desired to set down the assembly of garment bag and carrying case as shown in FIG. 1, it is preferred that the garment bag be provided with suitable means to protect the exposed garment bag from contact with the ground. For this purpose, and as shown in FIG. 3, a reinforcing member 72 having a height approximately equal to or slightly greater than the width of the bottom wall of the carrying case B is secured to the panel 12 as by sewing. The reinforcing member or strip is made of heavy material, such as leather or synthetic leather, and has secured thereto a plurality of spaced feet or studs 74 which will engage the horizontal surface or ground when the assembly of FIG. 1 is placed on the horizontal surface.

Figure 5:
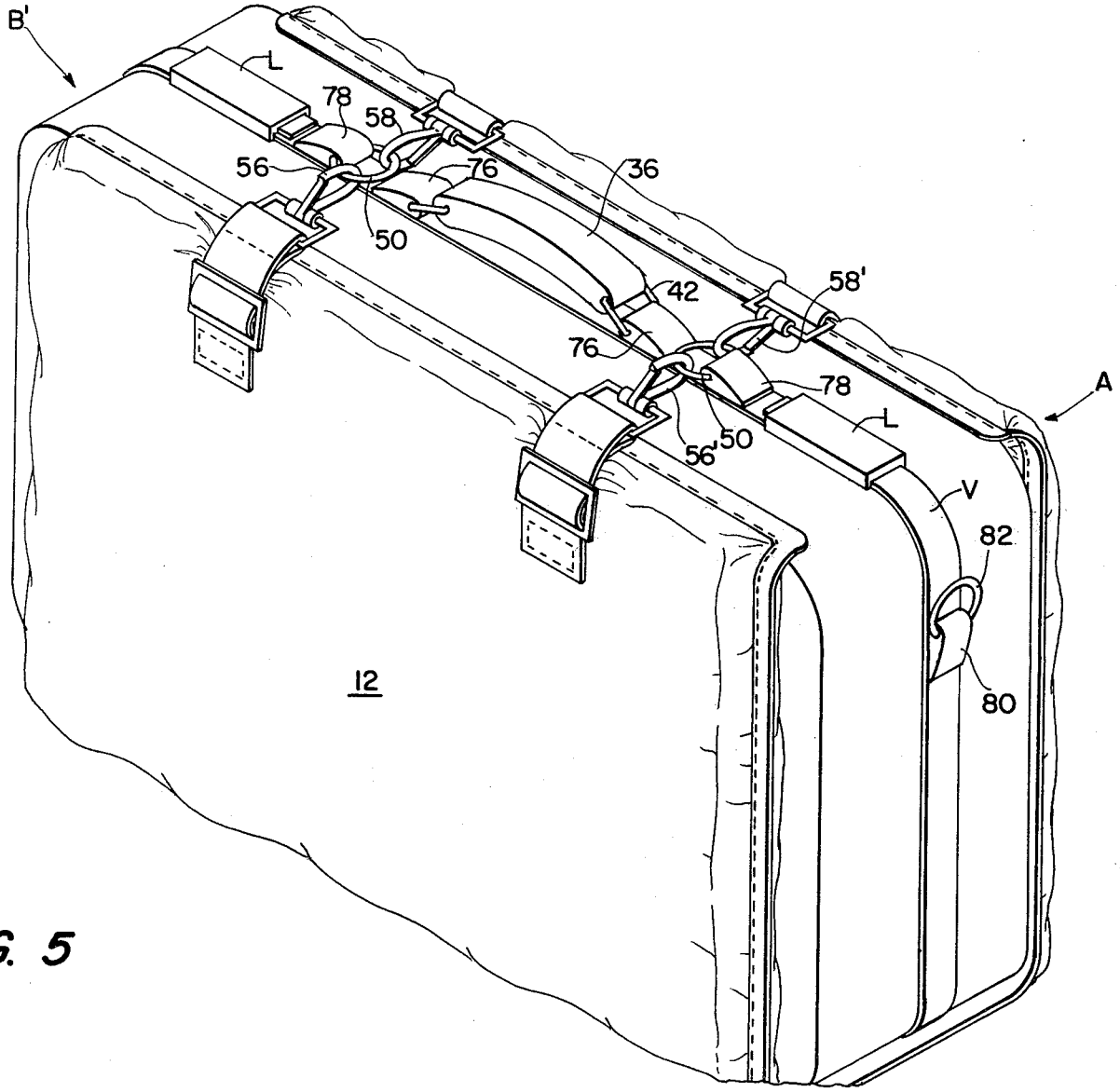
FIG. 5 is a view similar to FIG. 1, this view, however, showing another type of carrying case.

Instead of soft-side luggage for the carrying case as hereinbefore described, the garment bag A may be assembled or related to a hard-side case B' as illustrated in FIG. 5. The dimensional relationships of the garment bag and carrying case are the same as hereinbefore described in the embodiment of FIGS. 1–4. The only difference is that the case sections are molded or cast of a suitable plastic composition or metal alloy, and possess a sufficient measure of rigidity so that reinforcing members other than the usual valance member on at least one of the peripheral edges of a case section are unnecessary. The same or similar elements are given the same reference characters. The handle 36 is mounted on the valance member V by a pair of longitudinally spaced studs 76 which are secured to the valance member in a manner well known in the art, for example, the handle studs are die cast and provided with integral connecting studs or rivet portions on their undersides. The rivet portions are passed through openings in the valance and through aligned openings in the molded or cast shell and then the ends are headed over to secure the connection. The handle is connected to the studs by pivot rings 42.

Also, the connectors or rings 50 for cooperation with the longitudinally spaced connectors 56, 56' and 58, 58' secured to the second panel of the garment bag A are secured to the top wall of the carrying case by longitudinally spaced studs 78 which in turn are secured to the valance member in a manner as described for the handle studs. Also, as is common in the art, a pair of locks L of any suitable construction are mounted upon and secured to the valance member V for coaction with hasps (not shown) extending from the opposite shell. Connector studs 80 are secured to the valance member at the ends of the case to hold D-rings 82 and to receive connectors at the ends of a carrying strap to enable carrying of the assembly, or of the carrying case separately, as hereinbefore described in connection with the embodiment of FIGS. 1–4. One arrangement of a carrying case having a valance, a handle and locks mounted on molded shells as briefly described above is shown in greater detail in U.S. Pat. No. 3,186,197; Gehrie granted June 1, 1965.

Figure 6:
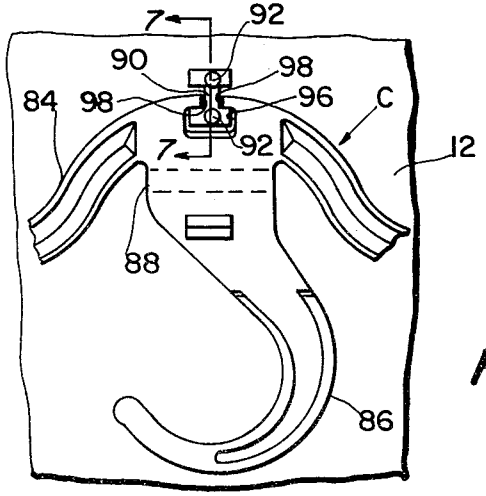
FIG. 6 is a partial plan view of a hanger suitable for use in the garment bag of the invention.

A hanger or hangers for the men's suits or women's dresses to be hung in the garment bag should be of a construction which does not interfere with the assembly of the garment bag and carrying case illustrated in FIGS. 1 and 5; that is to say, the hanger may not have any protruding portion which would interrupt the continuity or curvature of the garment bag. The hanger described in U.S. Pat. No. 3,870,206; Feinberg granted Mar. 11, 1975 is particularly adapted for use in the garment bag for assembly with the carrying case in accordance with the invention. This hanger will be briefly described herein and with reference to FIGS. 6 and 7.

The garment hanger C which is molded of plastic material to provide a substantially rigid plastic supporting frame 84 has a substantially rigid hook 86 hinged to the frame by a thin flexible section 88. The supporting frame, hook and hinge means are integrally connected and molded as a single integral piece from a suitable plastic composition for example, an olefin such as polypropylene or polyethylene. The unitary structure is molded so that the hook structure is normally in the position shown in FIG. 6. The plastic material at the hinge 88 has memory and the hook tends to return to the position of FIG. 6 from the "hanging position" as shown in FIG. 3.

Figure 7:
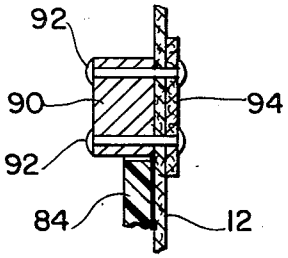
FIG. 7 is a vertical cross-sectional view taken approximately in the plane of line 7—7 of FIG. 6.

The hanger C or a plurality of such hangers may be used in the garment bag A and reliance placed upon the extended arms with respect to the opening 20 in the garment bag to prevent the hanger or hangers from being pulled out of the bag so that it is not necessary that any means be provided to secure the hangers in the garment bag. It is preferred, however, to provide a mounting for the hangers, and for this purpose, a short bracket member 90 is secured to the panel 12 of the garment bag. The bracket member has an I-beam cross section and the connection to the panel 12 is made by a pair of spaced, headed rivets 92. As shown in FIG. 7, the rivets extend through the bracket member and the material of the panel 12 and through a layer of heavy reinforcing material 94 to provide a secure connection of the bracket to the garment bag. The hanger C or a plurality of such hangers are each provided with a slot 96 of a contour for mating engagement with the bracket 90. The slot 96 is dimensioned so that the edges 98 will clear the bracket and the weight or mass of the hanger, and the clothes, thereon, causes the edges to engage the inner side of the bracket 90 which act as block points to prevent the hanger from falling off.

As previously indicated, the advantages of the invention may be realized by using a garment bag having a length sufficient to substantially cover the bottom wall and side walls of a carrying case, and preferably, the garment bag is of a length so that the ends thereof may be turned over onto the top wall and terminate on each side of the handle when the longitudinally spaced connectors secured to the garment bag are connected to the connector means secured to the top wall of the carrying case. For example, a garment bag and carrying case having the dimensions as hereinafter set forth have furnished all of the advantages and improved results of the invention. Germent bag: 41 inches long and 22 inches wide. Carrying case of the soft-side type: 22 inches long, 6¾ inches wide and 12 inches high. Such case has been variously termed an "underseater" or a "weekender". The space under the seat of an airplane is 13 inches wide, 23 inches long and 9 inches high. The garment bag may hold several women's dresses because of their lighter fabric. The garment bag may hold a man's suit, and in assembled relation with an underseater or weekender, such assembly may be placed under the seat.

A garment bag having the dimensions as above described may be assembled with hard-side over-night case 22 inches long, 7 inches wide and 13 inches high. Thoughsuch an assembly is somewhat larger than the dimensions under the seat in an airplane, there is still the substantial advantage of being able to carry the assembly of the garment bag and carrying case onto the airplane, stowing them as a assembly if there are suitable facilities in the passenger area. If not, the overnight case may be stowed under the seat and the garment bag hung on an available rack. When disembarking the reassembly of the two pieces of luggage may be very quickly and readily accomplished.

While several preferred embodiments of the invention have been illustrated and described, it is believed that various modifications or changes may be made without departing from the spirit and scope of the invention as sought to be defined in the claims.

I claim:

1. A garment bag-carrying case assembly, the garment bag comprising first and second panels of flexible material connected to one another at their edges, the first panel having a longitudinally extending opening provided with a closure, the carrying case comprising a bottom wall, side walls, end walls and a top wall, the top wall having a handle secured thereto, the carrying case having a length substantially equal to the width of the garment bag, the garment bag having a length sufficient to substantially cover said bottom wall and said side walls, connector means secured to the carrying case, and longitudinally spaced connector means secured to the second panel to extend from each end of the garment bag for separable connection to the connectormeans secured to the carrying case.

2. A garment bag-carrying case assembly according to claim 1, wherein the connector means secured to the carrying case is positioned on the top wall.

3. A garment bag-carrying case assembly according to claim 2, wherein the garment bag is of a length so that the ends thereof are turned over onto the top wall and terminate on each side of the handle when said longitudinally spaced connector means are connected to the connector means secured to said top wall.

4. A garment bag-carrying case assembly according to claim 2 or 3, wherein the connector means secured to said top wall comprise a pair of longitudinally spaced rings; and wherein the longitudinally spaced connector means secured to the second panel comprise pairs of transversely spaced hook fasteners.

5. A garment bag-carrying case assembly according to claim 4, wherein the transversely spaced hook fasteners are snap hook fasteners each connected to a flexible strap which is secured to said second panel; and wherein means is provided for adjusting the length of the straps for at least one pair of snap hook fasteners.

6. A garment bag-carrying case assembly according to claim 2, wherein means is provided on the carrying case for the connection thereto of a shoulder strap.

7. A garment bag-carrying case assembly according to claim 6, wherein the means provided for the connection thereto of a shoulder strap comprises a ring secured to each end wall of the carrying case.

8. A garment bag-carrying case assembly according to claim 4, wherein a reinforcing member is secured to and extends transversely of the second panel midway of its length, and means are connected to the reinforcing member for supporting the assembly when placed on a horizontal surface.

9. A garment bag-carrying case assembly according to claim 2, wherein the bottom wall, side walls, end walls and top wall are provided by a pair of case sections, the case sections being hinged to each other and fastener means being provided for securing the sections with their peripheral edges in adjoining relation.

10. A garment bag-carrying case assembly according to claim 9, wherein the case sections are of supported softside material, and the fastener means is a slide fastener.

11. A garment bag-carrying case assembly according to claim 9, wherein the case sections are of a molded plastic composition; wherein the peripheral edge of at least one of the case sections is provided with a valance member; wherein the fastener means comprises a latching device mounted on the valance member; and wherein the connector means is secured to the valance member.

12. A garment bag-carrying case assembly according to claim 4, wherein the bottom wall, side walls, end walls and top wall are provided by a pair of case sections, the case sections being hinged to each other and fastener means being provided for securing the sections with their peripheral edges in adjoining relation.

13. A garment bag-carrying case assembly according to claim 4, wherein the case sections are of supported soft-side material, and the fastener means is a slide fastener.

14. A garment bag-carrying case assembly according to claim 4, wherein the case sections are of a molded plastic composition; wherein the peripheral edge of at least one of the case sections is provided with a valance member; wherein the fastener means comprises a latching device mounted on the valance member; and wherein the connector means is secured to the valance member.

15. A garment bag comprising first and second panels of flexible material connected to one another at their edges, the first panel having a longitudinally extending opening provided with a closure, longitudinally spaced connector means secured to the second panel to extend from each end of the garment bag, a reinforcing member secured to and extending transversely of the second panel midway of its length, and means connected to the reinforcing member for engagement with a horizontal surface.

16. A garment bag comprising first and second panels of flexible material connected to one another at their edges, the first panel having longitudinally extending opening provided with a closure, and longitudinally spaced, transversely spaced pairs of hook fasteners secured to the second panel to extend from each end of the garment bag, each hook fastener being connected to a flexible strap which is secured to said second panel, means for adjusting the length of the straps for at least one pair of the fasteners, a reinforcing member secured to and extending transversely of the second panel midway of its length, and means connected to the reinforcing member for engagement with a horizontal surface.

17. A garment bag comprising first and second panels of flexible material connected to one another at their edges, the first panel having a longitudinally extending opening provided with a closure, a reinforcing member secured to and extending transversely of the second panel midway of its length, and means connected to the reinforcing member for engagement with a horizontal surface.

* * * * *